US011840824B2

(12) United States Patent
Yun et al.

(10) Patent No.: US 11,840,824 B2
(45) Date of Patent: Dec. 12, 2023

(54) HYDRAULIC MACHINE

(71) Applicant: Volvo Construction Equipment AB, Eskilstuna (SE)

(72) Inventors: Seonggeun Yun, Gyeongsangnam-do (KR); Byoungho Lee, Gyeongsangnam-do (KR); Hoenghwan Ahn, Gyeongsangnam-do (KR); Sangkyu Joo, Gyeongsangnam-do (KR); Seunghyun Lee, Gyeongsangnam-do (KR); Taerang Jung, Gyeongsangnam-do (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 0 days.

(21) Appl. No.: 18/079,928

(22) Filed: Dec. 13, 2022

(65) Prior Publication Data

US 2023/0203785 A1 Jun. 29, 2023

(30) Foreign Application Priority Data

Dec. 24, 2021 (KR) ..... 10-2021-0187541

(51) Int. Cl.
*E02F 9/22* (2006.01)
*F15B 1/02* (2006.01)
*F15B 1/027* (2006.01)

(52) U.S. Cl.
CPC ..... *E02F 9/2217* (2013.01); *F15B 1/024* (2013.01); *F15B 1/027* (2013.01)

(58) Field of Classification Search
CPC ..... F15B 1/027; F15B 1/024; F15B 21/082; E02F 9/2217; E02F 9/2246
See application file for complete search history.

(56) References Cited

U.S. PATENT DOCUMENTS 6,170,587 B1 1/2001 Bullock
10,704,229 B2 * 7/2020 Uemura ..... F15B 21/14
10,890,199 B2 * 1/2021 Hahn ..... F15B 1/033
(Continued)

FOREIGN PATENT DOCUMENTS

EP 2570381 A1 3/2013

OTHER PUBLICATIONS

Extended European Search Report, EP Application No. 22214059, dated May 19, 2023, 6 pages.

*Primary Examiner* — Abiy Teka
(74) *Attorney, Agent, or Firm* — SAGE PATENT GROUP

(57) ABSTRACT

Provided is a hydraulic machine. A pump pressurizes fluid using power provided by a power source. An actuator works using the pressurized fluid from the pump. A recovery part recovers energy from fluid discharged from the actuator. A first operator input device receives a desired input from operator to select an eco-mode or a boost mode. The recovery part includes an accumulator storing hydraulic energy by receiving the fluid discharged from the actuator and an assist unit assisting the power source using the hydraulic energy stored in the accumulator. The controller controls the pump such that output power of the pump does not exceed P1max when the eco-mode is selected or the assist unit does not assist the power source and that the output power does not exceed P2max when the boost mode is selected and the assist unit assists the power source, where P1max<P2max.

10 Claims, 4 Drawing Sheets

(56) References Cited

U.S. PATENT DOCUMENTS

| | | | | |
|---|---|---|---|---|
| 2013/0280111 | A1 | 10/2013 | Hoxie et al. | |
| 2016/0281330 | A1* | 9/2016 | Shang | E02F 3/425 |
| 2022/0162829 | A1* | 5/2022 | Jung | F15B 11/024 |

* cited by examiner

HYDRAULIC MACHINE

CROSS REFERENCE TO RELATED APPLICATIONS

This application claims priority to Korean Patent Application No. 10-2021-0187541, filed on Dec. 24, 2021, the disclosure and content of which is incorporated by reference herein in its entirety.

TECHNICAL FIELD

The present disclosure relates generally to a hydraulic machine. In particular aspects, the disclosure relates to a hydraulic machine able to selectively reduce fuel consumption by a power source or to boost maximum output power of a pump using hydraulic energy discharged from an actuator.

BACKGROUND

Recently, hybrid hydraulic machines recovering energy of fluid discharged from an actuator and assisting a power source using the recovered energy has come into prominence. However, such hybrid hydraulic machines only use the recovered energy in terms of fuel savings, and thus there is a limitation in that the power or speed of a working device may fail to meet an operator's desire.

SUMMARY

According to an aspect, provided is a hydraulic machine including: a power source; a pump configured to pressurize fluid and supply the pressurized fluid using power provided by the power source; an actuator configured to work using the pressurized fluid from the pump; a recovery part configured to recover energy from fluid discharged from the actuator; a first operator input device configured to receive a desired input from an operator to select an eco-mode or a boost mode; and a controller. The recovery part may include: an accumulator configured to store hydraulic energy by receiving the fluid discharged from the actuator; and an assist unit configured to assist the power source using the hydraulic energy stored in the accumulator. A technical benefit may include providing a hybrid hydraulic machine able to not only use recovered energy for fuel savings but to also use the recovered energy to meet an operator's desire when an operator desires a high operating speed of a working device, thereby improving satisfaction of the operator in using the equipment.

In some examples, the controller may control the pump such that output power of the pump is equal to or lower than P1max when the eco-mode is selected or when the assist unit does not assist the power source and the output power of the pump is equal to or lower than P2max when the boost mode is selected and the assist unit assists the power source, where P1max<P2max.

In some examples, the hydraulic machine may further include a second operator input device configured to set a rotational speed of the power source. P1max and P2max may vary depending on an input value input using the second operator input device.

In some examples, P2max may vary depending on the level of the hydraulic energy stored in the accumulator.

In some examples, the hydraulic machine may further include a third operator input device movable to indicate a desired movement of the actuator. The controller may control a displacement of the pump to vary depending on an amount of movement of the third operator input device, while limiting the displacement of the pump such that the output power of the pump does not exceed P1max when the eco-mode is selected or when the assist unit does not assist the power source and the output power of the pump does not exceed P2max when the boost mode is selected and the assist unit assists the power source.

The power source may be configured to drive the pump to rotate at a constant rotational speed.

In some examples, the hydraulic machine may further include a second operator input device configured to set a rotational speed of the power source. The constant rotational speed may vary depending on an input value input using the second operator input device.

In some examples, in a situation in which the boost mode is selected, the controller may control the recovery part such that the assist unit does not assist the power source when the output power of the pump is equal to or lower than P1max and the hydraulic energy stored in the accumulator is equal to or lower than a predetermined threshold value, and that the assist unit assists the power source when the output power of the pump is greater than P1max or when the hydraulic energy stored in the accumulator is greater than the predetermined threshold value.

In some examples, the recovery part further may include a discharge valve allowing or blocking flow of fluid between the accumulator and the assist unit. The discharge valve may be opened to allow the assist unit to assist the power source and is closed to prevent the assist unit from assisting the power source.

In some examples, the recovery part may further include a charge valve allowing or blocking flow of fluid between a bottom chamber of the actuator and the accumulator. The charge valve may be opened to allow the accumulator to be charged and is closed to prevent the accumulator from being charged.

In some examples, the hydraulic machine may further include a tank providing fluid for the pump. The recovery part may further include: a recovery line extending from a bottom chamber of the actuator to the accumulator; a regeneration valve allowing or blocking flow of fluid from the recovery line to a rod side chamber of the actuator; and a return valve allowing or blocking flow of fluid from the recovery line to the tank.

The above aspects, accompanying claims, and/or examples disclosed herein above and later below may be suitably combined with each other as would be apparent to anyone of ordinary skill in the art.

Additional features and advantages are disclosed in the following description, claims, and drawings, and in part will be readily apparent therefrom to those skilled in the art or recognized by practicing the disclosure as described herein. There are also disclosed herein control units, computer readable media, and computer program products associated with the above discussed technical benefits.

BRIEF DESCRIPTION OF THE DRAWINGS

With reference to the appended drawings, below follows a more detailed description of aspects of the disclosure cited as examples.

DETAILED DESCRIPTION

Aspects set forth below represent the necessary information to enable those skilled in the art to practice the disclosure.

Figure 1:
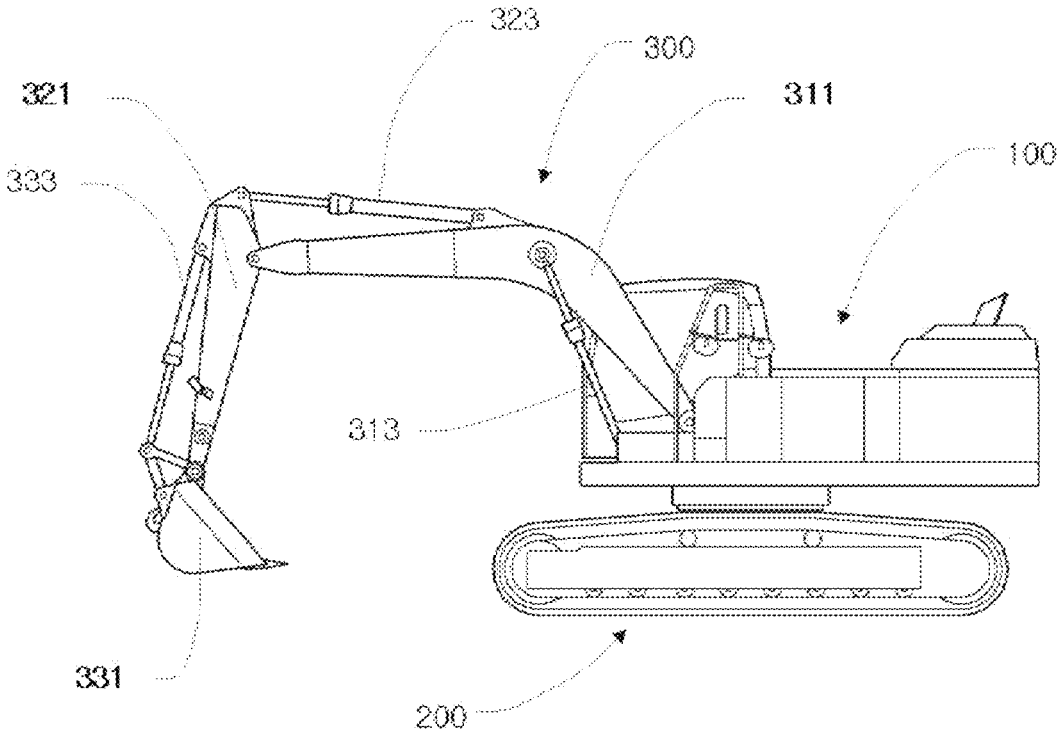
FIG. 1 is a view illustrating an external appearance of a hydraulic machine according to some examples.

FIG. 1 is a view illustrating an external appearance of a hydraulic machine according to some examples.

A hydraulic machine may work by operating a working device 300 using hydraulic pressure. In some examples, the hydraulic machine may be a construction machine.

In some examples, the hydraulic machine may be an excavator as illustrated in FIG. 1. The hydraulic machine may include an upper structure 100, a lower structure 200, and the working device 300.

The lower structure 200 includes a travel actuator to allow the hydraulic machine to travel. The travel actuator may be a hydraulic motor.

The upper structure 100 may include a tank, a pump, a power source, a control valve, and the like. In addition, the upper structure 100 includes a swing actuator to be able to swing with respect to the lower structure 200. The swing actuator may be a hydraulic motor.

The working device 300 allows the hydraulic machine to work. The working device 300 may include a boom 311, an arm 321, and a bucket 331, as well as a boom actuator 313, an arm actuator 323, and a bucket actuator 333 for actuating the boom 311, the arm 321, and the bucket 331. The boom actuator 313, the arm actuator 323, and the bucket actuator 333 may be hydraulic cylinders.

Figure 2:
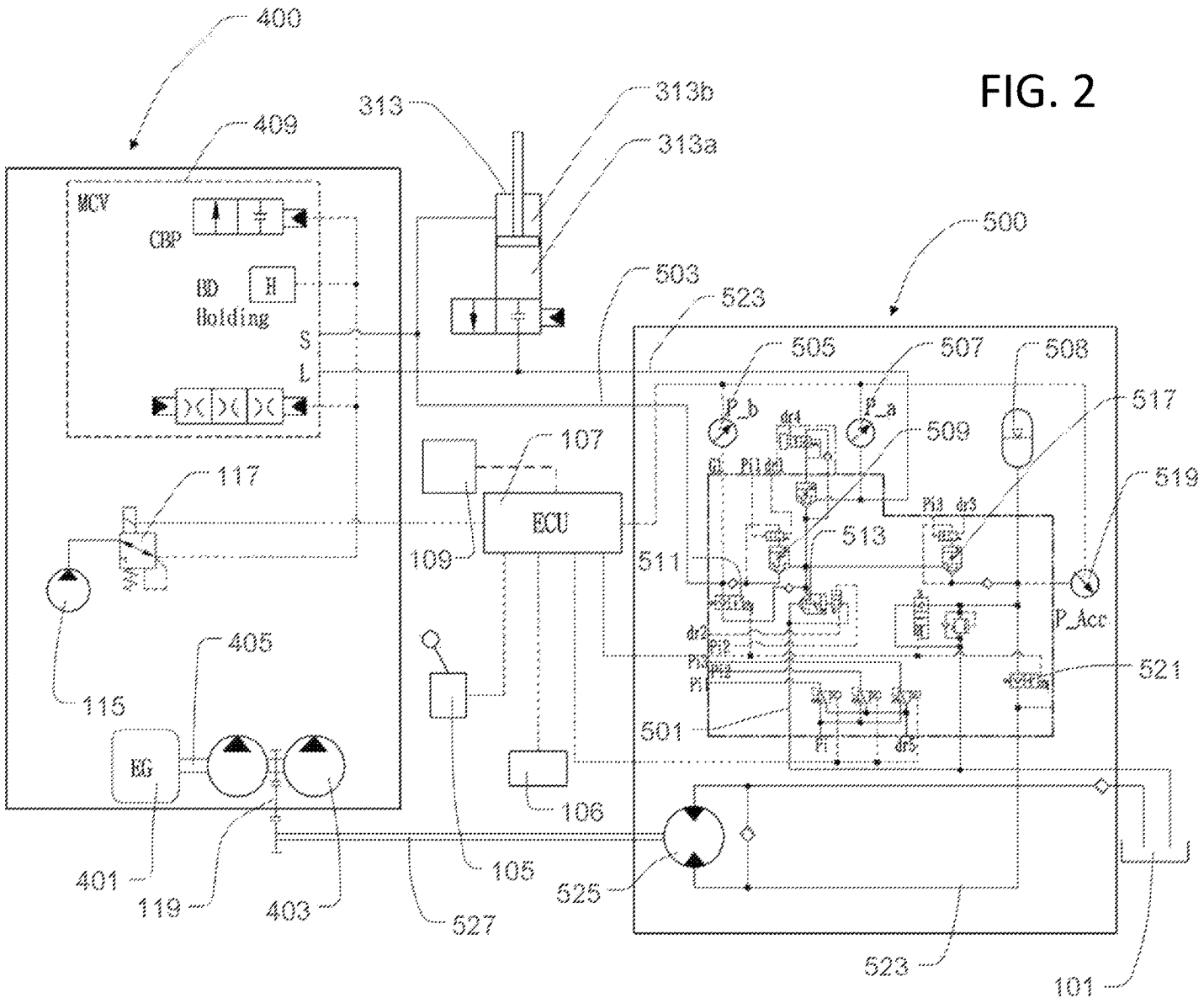
FIG. 2 is a circuit diagram illustrating a hydraulic machine according to some examples.

FIG. 2 is a circuit diagram illustrating a hydraulic machine according to some examples.

In some examples, the hydraulic machine may include an actuator, an energy recovery part 500, a tank 101, and a controller 107. In some examples, the actuator may be the boom actuator 313. The energy recovery part 500 may be provided between the boom actuator 313 and the tank 101. The energy recovery part 500 may be connected to the boom actuator 313 to recover energy from fluid discharged from the boom actuator 313. In some examples, the energy recovery part 500 may include an accumulator 508 and an assist unit 525. In some examples, the energy recovery part 500 may include a charge valve 517 and a discharge valve 521. In some examples, the energy recovery part 500 may include a return valve 513 and a regeneration valve 509.

In some examples, the hydraulic machine may include an energy consumption part 400. The energy consumption part 400 may be provided between the tank 101 and the boom actuator 313. The energy consumption part 400 is a circuit connected to the boom actuator 313 to supply pressurized fluid to the boom actuator 313 and return fluid discharged from the boom actuator 313 to the tank 101. In some examples, the energy consumption part 400 may include a power source 401, a main pump 403, and a control valve 409. The main pump 403 may direct the pressurized fluid toward the boom actuator 313. The power source 401 may drive the main pump 403. In some examples, the power source 401 may include an engine, such as an internal combustion engine, an electric motor, or the like.

In some examples, the hydraulic machine may actuate the working device using the energy consumption part 400 at normal time and recover energy using the energy recovery part 500 when a hybrid function is intended to be performed.

In some examples, the power source 401 may drive the main pump 403 by supplying power to the main pump 403 through a main shaft 405. The main pump 403 may pressurize fluid and direct the pressurized fluid toward the boom actuator 313. The boom actuator 313 may receive the pressurized fluid from the main pump 403 and return the fluid toward the tank 101. The boom actuator 313 may actuate the boom by providing the force of the pressurized fluid received from the main pump 403 to the boom. [0035] in some examples, the boom actuator 313 may be a hydraulic cylinder, and may include a bottom chamber 313*a* and a rod side chamber 313*b*. Since a piston rod connected to the boom extends through the rod side chamber 313*b*, an area Ab in which fluid inside the rod side chamber 3131) is in contact with the piston is smaller than an area. Aa in which fluid inside the bottom chamber 313*a* is in contact with the piston, due to the area occupied by the piston rod. Referring to FIG. 1 together with FIG. 2, in a boom down operation in which the boom is lowered, the piston rod is also lowered. Consequently, fluid enters the rod side chamber 313*b*, while fluid is discharged from the bottom chamber 313*a*.

The control valve 409 may control flow directions of fluid between the main pump 403, the tank 101, and the boom actuator 313 by fluidly connecting the main pump 403, the tank 101, and the boom actuator 313. In some examples, the control valve 409 may have a neutral position, a first non-neutral position, or a second non-neutral position. When in the neutral position, the control valve 409 may be operated to not be in fluid communication with the boom actuator 313 and return the fluid that has flowed from the main pump 403 to the tank 101 through a central bypass path. When the control valve 409 is in the first non-neutral position, the control valve 409 may prevent the fluid that has flowed from the main pump 403 from returning to the tank 101 through the central bypass path, direct the fluid that has flowed from the main pump 403 to the rod side chamber 313*b*, and direct the fluid that has flowed from the bottom chamber 313*a* to the tank 101, thereby moving the boom down. When the control valve 409 is in the second non-neutral position, the control valve 409 may prevent the fluid that has flowed from the main pump 403 from returning to the tank 101 through the central bypass path, direct the fluid that has flowed from the main pump 403 to the bottom chamber 313*a*, and direct the fluid that has flowed from the rod side chamber 313*b* to the tank 101, thereby moving the boom up.

In some examples, the hydraulic machine may include a third operator input device 105 to move the control valve 409. An operator may input his/her desire to raise or lower the boom by operating the third operator input device 105. In some examples, the third operator input device 105 may be a lever, but the present disclosure is not limited thereto.

In some examples, the third operator input device 105 may be an electrical input device, and may generate an electrical signal indicative of the operator's desire and transmit the electrical signal to the controller 107. In some examples, the hydraulic machine may include a pilot pump 115 and an electronic proportional pressure reducing valve 117. When receiving an electrical signal from the third operator input device 105, the controller 107 may responsively operate the electronic proportional pressure reducing valve 117 by transmitting a control signal to the electronic proportional pressure reducing valve 117. When the electronic proportional pressure reducing valve 117 is in a first position, the electronic proportional pressure reducing valve 117 may direct pilot fluid that has flowed from the pilot pump 115 to the control valve 409 to operate the control valve 409. When the electronic proportional pressure reducing valve 117 is in a second position, the electronic proportional pressure reducing valve 117 may block flow of the pilot fluid from the pilot pump 115 to the control valve 409 and allow pilot fluid that has been provided to the control valve 409 to drain.

The return valve 513 may be provided between the bottom chamber 313*a* and the tank 101 to allow or block flow of fluid from the bottom chamber 313*a* to the tank 101. The regeneration valve 509 may connect or disconnect the bottom chamber 313*a* and the rod side chamber 313*b* to allow or block flow of fluid from the bottom chamber 313*a* to the rod side chamber 313*b*. The charge valve 517 may be provided between the bottom chamber 313*a* and the accumulator 508 to allow or block flow of fluid from the bottom chamber 313*a* to the accumulator 508.

The assist unit 525 is a power recovery component. In some examples, the assist unit 525 may be a hydraulic motor (e.g., an assist motor). The assist motor may assist the power source 401 to provide the recovered power to the power source 401. In this regard, in some examples, the hydraulic machine may include a power transmission. The power transmission may be connected to the power source 401 and the assist unit 525 to transmit power therebetween. In some examples, the power transmission may include the main shaft 405 connecting the power source 401 and the main pump 403, an assist shaft 527 connected to the assist unit 525, and a power transmission part 119. In some examples, the power transmission part 119 may include a gear train as illustrated in FIG. 2. However, the present disclosure is not limited thereto, and a variety of other examples are possible.

In some examples, the hydraulic machine may include a fourth operator input device (not shown) configured to receive a desired input from the operator to select or deselect a hybrid mode. When the desire to select the hybrid mode is input to the fourth operator input device and a boom down desire is input to the third operator input device 105, the controller 107 may control the electronic proportional pressure reducing valve 117 such that the pilot fluid is not supplied to the control valve 409, thereby moving the control valve 409 to the neutral position. In this manner, the controller 107 may block flow of fluid between the energy consumption part 400 and the boom actuator 313. Thus, in a situation in which the hybrid mode is selected, the boom down operation may only be induced by the weight thereof without the supply of the pressurized fluid by the main pump 403. When the desire to deselect the hybrid mode is input to the fourth operator input device or when no boom down desire is input to the third operator input device 105 even in the case that the desire to select the hybrid mode is input to the fourth operator input device, the controller 107 may move the return valve 513, the regeneration valve 509, and the charge valve 517 to block flow of fluid between the boom actuator 313 and the energy recovery part 500.

In some examples, in the boom down operation in which the boom is lowered, the return valve 513 may be operated to block flow of fluid from the bottom chamber 313*a* to the tank 101. When the difference between the pressure in the bottom chamber 313*a* and the pressure in the accumulator 508 substantially approaches 0, the boom down speed may be slowed. In some examples, the return valve 513 may be opened at this time. In the boom down operation, the regeneration valve 509 may be operated to allow flow of fluid from the bottom chamber 313*a* to the rod side chamber 313*b*. In the boom down operation, the charge valve 517 may be operated to allow flow of fluid from the bottom chamber 313*a* to the accumulator 508.

In some examples, the energy recovery part 500 may include a recovery line 523 connecting the bottom chamber 313*a* and the assist unit 525. In some examples, the charge valve 517 may be provided on the recovery line 523. In some examples, the discharge valve 521 may be provided on the recovery line 523. In some examples, the accumulator 508 may be connected to the recovery line 523 at a first point between the charge valve 517 and the discharge valve 521. The charge valve 517 may allow or block flow of fluid from the bottom chamber 313*a* to the accumulator 508 through the recovery line 523. The discharge valve 521 may be disposed on the recovery line 523, at a location between the first point and the assist unit 525, to allow or block flow of fluid from the accumulator 508 to the assist unit 525.

In some examples, in the boom down operation, the controller 107 may control the regeneration valve 509 and the charge valve 517 such that about half of a high-pressure flow rate discharged from the bottom chamber 313*a* flows through the regeneration valve 509 to the rod side chamber 313*b* to be regenerated and the remaining amount of the flow rate flows through the charge valve 517 to be stored in the accumulator 508. The stored flow rate may be supplied to the assist unit 525 through the discharge valve 521. Here, an amount of boom down energy to be lost is determined depending on how much areas the regeneration valve 509, the charge valve 517, and the discharge valve 521 are controlled to open. In some examples, in the boom down operation (i.e., as the boom down operation desire by the operator using the third operator input device 105 is input to the controller 107), the controller 107 may open the regeneration valve 509 and the charge valve 517 to the maximum extent and close the return valve 513 so as to minimize pressure loss. In addition, in the boom down operation (i.e., as the boom down operation desire by the operator using the third operator input device 105 is input to the controller 107), the controller 107 may, in consideration of the basic loss of the assist unit, control the opening area of the discharge valve 521 to be smaller than each of the opening areas of the regeneration valve 509 and the charge valve 517 at an early stage of the boom down operation and then control the discharge valve 521 to be opened to the maximum extent, to comply with the characteristics of the boom down operation. In some other examples, the discharge valve 521 may be closed when the boom down operation is initiated and be opened when the pressure inside the accumulator 508 is equal to or higher than a predetermined pressure level.

In some examples, the hydraulic machine may include a first sensor 519 measuring pressure in the accumulator 508. In addition, the hydraulic machine may include a second sensor 507 measuring pressure in the bottom chamber 313*a* and a third sensor 505 measuring pressure in the rod side chamber 313*b*.

In some examples, the hydraulic machine may include a first operator input device 109 configured to receive a desired input from the operator to select an eco-mode or a boost triode.

In some examples, the hydraulic machine may include a second operator input device 106 configured to set a rotational speed of the power source.

Figure 3:
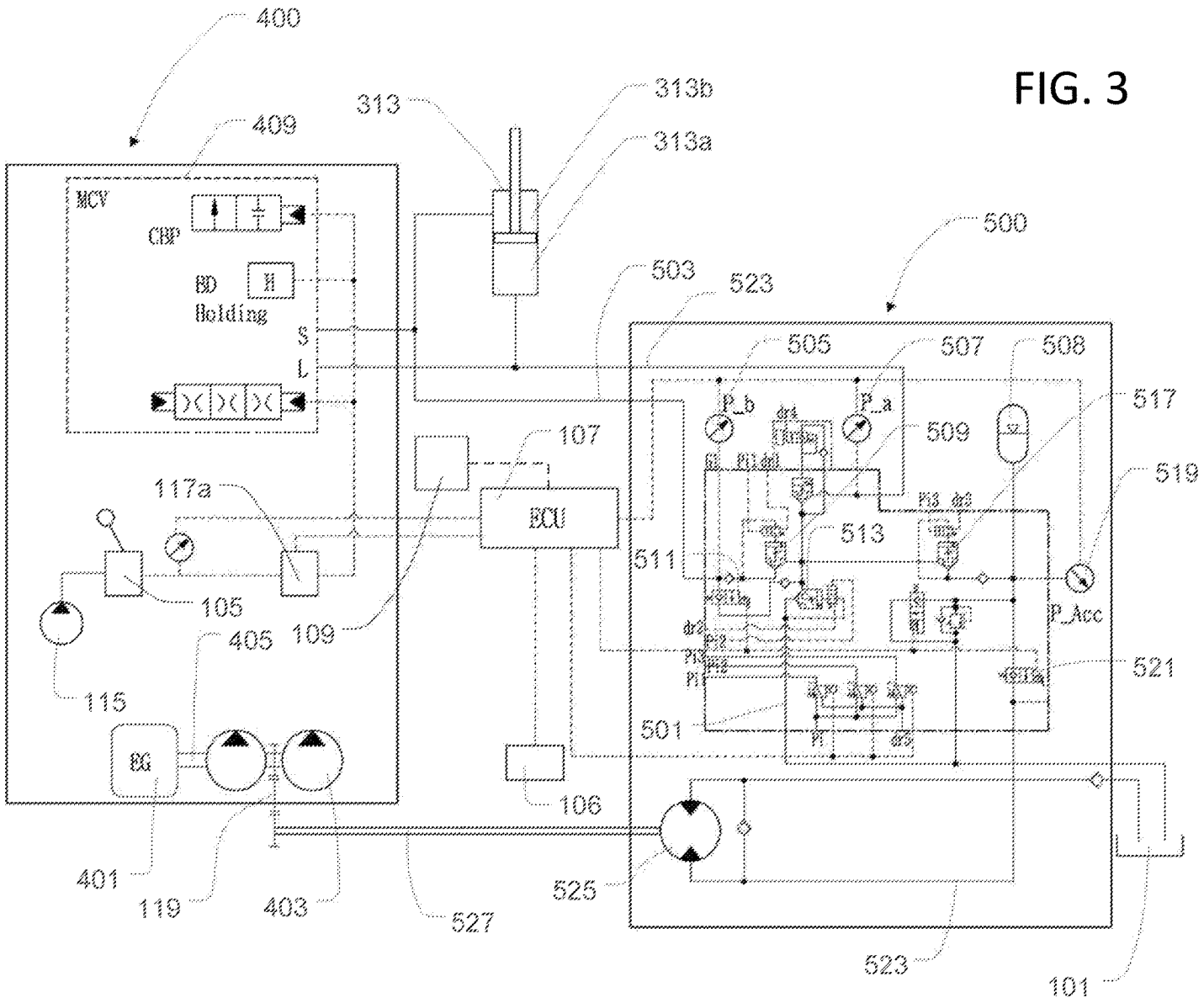
FIG. 3 is a circuit diagram illustrating a hydraulic machine according to some examples.

FIG. 3 is a circuit diagram illustrating a hydraulic machine according to some examples.

In some alternative examples, the third operator input device 105 may be a hydraulic input device including built-in pressure reducing valve (not shown), the hydraulic machine may include an auxiliary valve 117*a*. In these examples, the pilot pump 115 may be connected to the pressure reducing valve of the third operator input device 105, and the pressure reducing valve may transmit a hydraulic signal corresponding to the operator's desired input using the third operator input device 105 to the auxiliary valve 117*a*. In some examples, the hydraulic machine may include a sensor measuring the pressure of the hydraulic signal transmitted to the auxiliary valve 117*a* by the pressure reducing valve. The sensor may generate an electrical signal corresponding to the hydraulic signal and provide the electrical signal to the controller 107. Thus, even that the controller 107 is not directly connected to the third operator input device 105 the controller 107 may determine what desire is input by the operator, i.e., whether a boom down operation desire is input or a boom up operation desire is input. When a desire to deselect the hybrid mode is input using the fourth operator input device, a hydraulic signal generated by the third operator input device 105 may be transmitted to the control valve 409 through the auxiliary valve 117*a*. However, when the desire to select the hybrid mode is input to the fourth operator input device, even the case that the boom down desire is input to the third operator input device 105, the controller 107 may control the auxiliary valve 117*a* such that the pilot fluid is not supplied to the control valve 409, thereby moving the control valve 409 to the neutral position. Consequently, flow of fluid between the boom actuator 313 and the energy consumption part 400 may be blocked.

Figure 4:
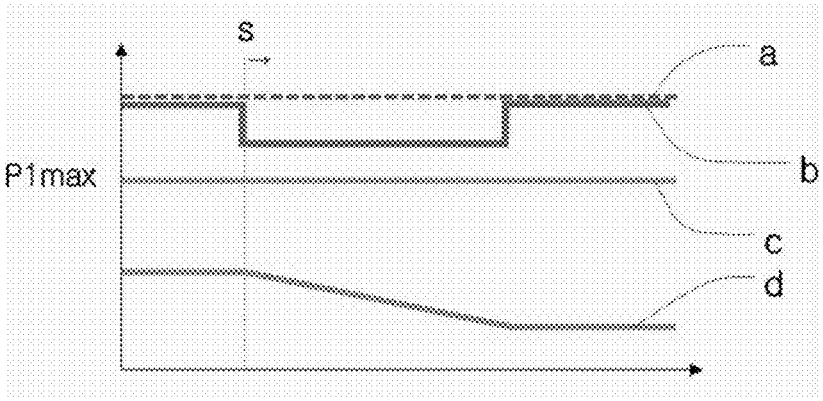
FIG. 4 is a graph illustrating changes in power of the pump and the power source and changes in energy in the accumulator when an eco-mode is selected according to an example of the present disclosure.
Figure 5:
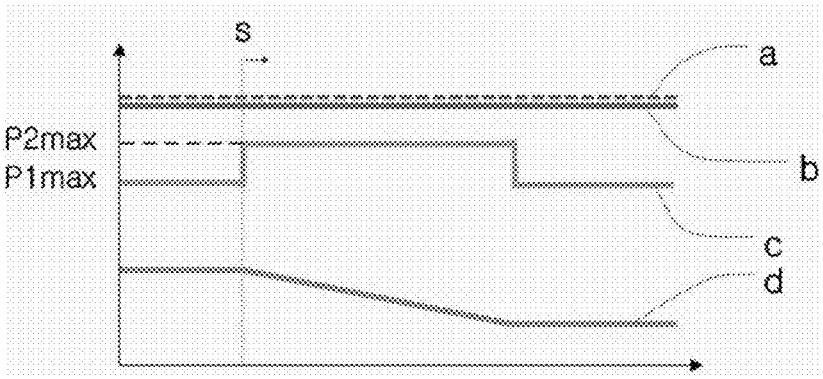
FIG. 5 is a graph illustrating changes in power of the pump and the power source and changes in energy in the accumulator when a boost mode is selected according to an example of the present disclosure.

FIG. 4 is a graph illustrating changes in power of the pump and the power source and changes in energy in the accumulator when the eco-mode is selected according to an example of the present disclosure, and FIG. 5 is a graph illustrating changes in power of the pump and the power source and changes in energy in the accumulator when the boost mode is selected according to an example of the present disclosure.

In FIGS. 4 and 5, 's' indicates a start point of assisting the power source, 'a' indicates a power limit of the power source, 'b' indicates the used power of the power source, 'c' indicates the power of the pump, and 'd' indicates the energy in the accumulator.

When the boost mode is selected using the first operator input device 109, the maximum output power of the main pump 403 may be increased. When the eco-mode is selected, fuel consumed by the power source 401 may be reduced instead of increasing the maximum output power of the main pump 403.

In some examples, when the assist unit 525 does not assist the power source 401 (i.e., when the discharge valve 521 as illustrated in FIGS. 2 and 3 is closed) or when the eco-mode is selected as illustrated in FIG. 4, the main pump 403 may be controlled such that the output power thereof is equal to or lower than P1max. Meanwhile, as illustrated in FIG. 5, in a situation in which the boost mode is selected, when the assist unit 525 assists the power source 401 (i.e., the discharge valve 521 as illustrated in FIGS. 2 and 3 is opened), the main pump 403 may be controlled such that the output power thereof is equal to or lower than P2max. Here, P1max<P2max.

Even in the case that the maximum torque of the main pump 403 presented in the specification provided by the manufacturer of the main pump 403 is, for example, 2300 Nm, hydraulic machine manufacturers generally set the maximum torque of the main pump 403 to a lower value, for example, 2000 Nm for the safety of equipment. Thus, this gap can be used, and the maximum torque of the main pump 403 may be increased to some extent if necessary.

FIG. 4 assumes a case in which output power of the main pump 403 determined by a flow rate desired by the operator using the third operator input device 105 is greater than P1max. Although power greater than P1max should be output by the main pump 403 to meet the operator's desire, the output power of the main pump 403 is limited to P1max due to a limitation in the maximum output power. When there is no assist by the assist unit 525, the power source 401 supplies power P1max to the main pump 403 (when power transmission loss is neglected). When there is assist by the assist unit 525, the power source 401 may reduce the supply of power by the assisted amount of power, thereby reducing the consumption of power of the power source 401.

FIG. 5 assumes a case in which output power of the main pump 403 determined by a flow rate desired by the operator using the third operator input device 105 is greater than P1max. Although power greater than P1max should be output to meet the operator's desire, the output power of the main pump 403 is limited to P1max due to the limitation in the maximum output power. Thus, when there is no assist by the assist unit 525, the power source 401 supplies power P1max to the main pump 403 (when the power transmission loss is neglected). In contrast, when there is assist by the assist unit 525, the maximum output power of the main pump 403 may be increased. However, even in this case, the maximum output power of the main pump 403 cannot be increased limitlessly, but is limited to P2max. In this case, no fuel saving effect as in the eco-mode may not be obtained, but the operator's desire may be met to the maximum extent by power boosting, thereby improving the power or speed of equipment that the operator feels.

When the operator moves the third operator input device 105, the control valve 409 as illustrated in FIGS. 2 and 3 is moved depending on the amount of the movement and for example, the angle of inclination of a swash plate of the main pump 403 is changed depending on the amount of the movement, thereby changing the displacement of the main pump 403. However, even in the case that the operator desires a large displacement of the main pump 403 by increasing the amount of the movement of the third operator input device 105, an increase in the displacement results in an increase in the output power of the main pump 403 and thus the displacement of the main pump 403 is limited by the set maximum output power of the main pump 403. That is, the working device such as the boom may not be operated at the speed (i.e., flow rate) desired by the operator. Accordingly, the present disclosure is intended to meet the operator's desire to the maximum extent by allowing the power boosting when a predetermined condition is met in order to overcome this limitation. Here, the increased output power is not exclusively obtained from the power source 401 but a predetermined portion of the increased output power is obtained from the assist unit 525 in order to enable the power boosting.

In some examples, when the eco-mode is selected or when the assist unit 525 does not assist the power source 401, the displacement of the main pump 403 may be limited so that the output power of the main pump 403 is not greater than P1max. When the boost mode is selected and the assist unit 525 assists the power source 401, the displacement of the main pump 403 may be limited so that the output power of the main pump 403 is not greater than P2max.

Table 1 below illustrates the relationship between the rotational speed of the power source 401 (thus the rotational speed of the main pump 403) and maximum output power P1max and P2max of the main pump 403 set using the second operator input device 106.

TABLE 1

| Mode | P1max | P2max | Rotational Speed of Power Source |
|---|---|---|---|
| 10 | 100% | 105% | 2000 rpm |
| 9 | 95% | 100% | 1900 rpm |
| 8 | 90% | 95% | 1800 rpm |
| 7 | 85% | 90% | 1700 rpm |
| 6 | 80% | 85% | 1600 rpm |
| . . . | . . . | . . . | . . . |

In some examples, as illustrated in Table 1, P1max and P2max may vary depending on an input value input using the second operator input device 106. For example, the higher the rotational speed of the power source set using the second operator input device, the greater the maximum output power P1max and P2max may be. The lower the rotational speed of the power source set using the second operator input device, the lower the maximum output power P1max and P2max may be. In some examples, P2max may vary depending on the level of hydraulic energy stored in the accumulator. When hydraulic energy stored in the accumulator is not large and thus the assistable amount of power is not high, P2max may have a low amount. When hydraulic energy stored in the accumulator is high and thus the assistable amount of power is large, P2max may have a high amount.

In some examples, the power source 401 may be controlled to drive the main pump 403 to rotate at a constant speed (irrespective of input values input using the first operator input device 109 and the third operator input device 105). For example, even when the operator increases the amount of the movement of the third operator input device 105, the power source 401 may rotate at the set constant speed of rotation without changes in the speed of rotation. However, the constant speed of rotation may vary depending on the input value input using the second operator input device 106. For example, in Table 1 above, the power source 401 may have a higher speed of rotation in mode 10 than in mode 9, and thus a greater amount of fuel may be consumed in mode 10 than in mode 9.

In some examples, in a situation in which the boost mode is selected, when the output power of the main pump 403 is equal to or lower than P1max and the amount of energy charged in the accumulator is equal to or lower than a predetermined threshold value, the recovery part may be controlled such that the assist unit does not assist the power source 401 (i.e., the discharge valve 521 may be closed). In addition, when the output power of the main pump 403 is greater than P1max or when the amount of energy charged in the accumulator is greater than the threshold value, the recovery part may be controlled such that the assist unit assists the power source 401 (i.e., the discharge valve 521 may be opened). In the former situation, the power assist is not significantly required, and thus energy stored in the accumulator is continuously kept in order to be prepared for the future. In the latter situation, the power assist is required immediately or the amount of energy that has been charged up to present is sufficient, and thus the energy stored in the accumulator is used.

The terminology used herein is for the purpose of describing particular aspects only and is not intended to be limiting of the disclosure. As used herein, the singular forms "a," "an," and "the" are intended to include the plural forms as well, unless the context clearly indicates otherwise. As used herein, the term "and/or" includes any and all combinations of one or more of the associated listed items. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

It will be understood that, although the terms first, second, etc., may be used herein to describe various elements, these elements should not be limited by these terms. These terms are only used to distinguish one element from another. For example, a first element could be termed a second element, and, similarly, a second element could be termed a first element without departing from the scope of the present disclosure.

Relative terms such as "below" or "above" or "upper" or "lower" or "horizontal" or "vertical" may be used herein to describe a relationship of one element to another element as illustrated in the Figures. It will be understood that these terms and those discussed above are intended to encompass different orientations of the device in addition to the orientation depicted in the Figures. It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this disclosure belongs. It will be further understood that terms used herein should be interpreted as having a meaning consistent with their meaning in the context of this specification and the relevant art and will not be interpreted in an idealized or overly formal sense unless expressly so defined herein.

It is to be understood that the present disclosure is not limited to the aspects described above and illustrated in the drawings; rather, the skilled person will recognize that many changes and modifications may be made within the scope of the present disclosure and appended claims. In the drawings and specification, there have been disclosed aspects for purposes of illustration only and not for purposes of limitation, the scope of the inventive concepts being set forth in the following claims.

What is claimed is:

1. A hydraulic machine comprising:

a power source;

a pump configured to pressurize fluid and supply the pressurized fluid using power provided by the power source;

an actuator configured to work using the pressurized fluid from the pump;

a recovery part configured to recover energy from fluid discharged from the actuator;

a first operator input device configured to receive a desired input from an operator to select an eco-mode or a boost mode; and a controller, wherein the recovery part comprises:

an accumulator configured to store hydraulic energy by receiving the fluid discharged from the actuator; and an assist unit configured to assist the power source using the hydraulic energy stored in the accumulator, and the controller controls the pump such that:

output power of the pump is equal to or lower than P1max when the eco-mode is selected or when the assist unit does not assist the power source, and the output power of the pump is equal to or lower than P2max when the boost mode is selected and the assist unit assists the power source, where P1max<P2max.

2. The hydraulic machine of claim 1, further comprising a second operator input device configured to set a rotational speed of the power source, wherein P1max and P2max vary depending on an input value input using the second operator input device.

3. The hydraulic machine of claim 1, wherein P2max varies depending on the level of the hydraulic energy stored in the accumulator.

4. The hydraulic machine of claim 1, further comprising a third operator input device movable to indicate a desired movement of the actuator, wherein the controller controls a displacement of the pump to vary depending on an amount of movement of the third operator input device, while limiting the displacement of the pump such that the output power of the pump does not exceed P1max when the eco-mode is selected or when the assist unit does not assist the power source and the output power of the pump does not exceed P2max when the boost mode is selected and the assist unit assists the power source.

5. The hydraulic machine of claim 1, wherein the power source is configured to drive the pump to rotate at a constant rotational speed.

6. The hydraulic machine of claim 5, further comprising a second operator input device configured to set a rotational speed of the power source, wherein the constant rotational speed varies depending on an input value input using the second operator input device.

7. The hydraulic machine of claim 1, wherein, in a situation in which the boost mode is selected, the controller controls the recovery part such that:

the assist unit does not assist the power source when the output power of the pump is equal to or lower than P1max and the hydraulic energy stored in the accumulator is equal to or lower than a predetermined threshold value, and the assist unit assists the power source when the output power of the pump is greater than P1max or when the hydraulic energy stored in the accumulator is greater than the predetermined threshold value.

8. The hydraulic machine of claim 1, wherein the recovery part further comprises a discharge valve allowing or blocking flow of fluid between the accumulator and the assist unit, wherein the discharge valve is opened to allow the assist unit to assist the power source and is closed to prevent the assist unit from assisting the power source.

9. The hydraulic machine of claim 1, wherein the recovery part further comprises a charge valve allowing or blocking flow of fluid between a bottom chamber of the actuator and the accumulator, wherein the charge valve is opened to allow the accumulator to be charged and is closed to prevent the accumulator from being charged.

10. The hydraulic machine of claim 1, further comprising a tank providing fluid for the pump, wherein the recovery part further comprises:

a recovery line extending from a bottom chamber of the actuator to the accumulator;

a regeneration valve allowing or blocking flow of fluid from the recovery line to a rod side chamber of the actuator; and a return valve allowing or blocking flow of fluid from the recovery line to the tank.

* * * * *